US007856748B1

(12) United States Patent
Mertz

(10) Patent No.: US 7,856,748 B1
(45) **Date of Patent: *Dec. 28, 2010**

(54) BIPOD SUPPORT AND MOUNT

(76) Inventor: Dean W. Mertz, Box 84 Wolfe Rd., Montandon, PA (US) 17850

( * ) Notice: Subject to any disclaimer, the term of this patent is extended or adjusted under 35 U.S.C. 154(b) by 0 days.

This patent is subject to a terminal disclaimer.

(21) Appl. No.: 12/204,821

(22) Filed: Sep. 5, 2008

Related U.S. Application Data

(60) Provisional application No. 60/971,005, filed on Sep. 10, 2007.

(51) Int. Cl.
*F41A 23/08* (2006.01)

(52) U.S. Cl. ..... 42/94; 42/71.01; 89/37.04

(58) Field of Classification Search ..... 42/94; 89/37.01, 37.03, 37.04; 124/29; D22/108, D22/109; 248/168, 371, 439
See application file for complete search history.

(56) References Cited

U.S. PATENT DOCUMENTS 1,382,409 A * 6/1921 Butler ..... 42/94
3,235,998 A * 2/1966 Hadley ..... 42/94
4,397,112 A * 8/1983 York ..... 42/94
4,776,124 A * 10/1988 Clifton ..... 42/94
5,029,407 A * 7/1991 Kirkpatrick ..... 42/94
5,755,526 A * 5/1998 Stanevich ..... 403/122
5,852,892 A * 12/1998 Bilgeri et al. ..... 42/94
5,903,995 A * 5/1999 Brubach ..... 42/94
6,289,622 B1 * 9/2001 Desch et al. ..... 42/94
7,100,318 B1 * 9/2006 Beltz ..... 42/94
2003/0192223 A1 * 10/2003 Sharp ..... 42/94
2006/0037228 A1 * 2/2006 Benson ..... 42/94
2008/0134560 A1 * 6/2008 Pierce et al. ..... 42/94
2008/0307689 A1 * 12/2008 Dotson ..... 42/94

* cited by examiner

*Primary Examiner*—Benjamin P Lee
(74) *Attorney, Agent, or Firm*—John J. Elnitski, Jr.

(57) ABSTRACT

A bipod support to support a firearm. There is a leg support. There are two legs, where each of the legs includes a support end. The support end includes a pin hole. The leg support includes two leg slots to receive one of the two legs. The leg support includes two pin holes. The support ends attached to the leg support by placing each of the support ends in one of the leg slots and inserting a pin into the pin holes of the leg support and the support end of the legs. There is a spring between each of the leg slots and each of the support ends of the legs. There is a ball to be mounted to a rifle stock. The ball is spherical in shape with two flat entrance sides on the ball. There is a ball mount receiver to receive the ball.

13 Claims, 17 Drawing Sheets

BIPOD SUPPORT AND MOUNT

This application claims the benefit of and incorporates by reference U.S. Provisional Application No. 60/971,005 filed Sep. 10, 2007.

BACKGROUND

The present invention generally relates to bipod supports. More specifically, the present invention relates to bipods supports used with firearms.

Bipod supports are used mainly to support firearms such as rifles, where the user of the rifle supplies the third point of support to position the rifle. The bipod is usually attached to the front of a rifle stock. Bipods currently on the market can be complicated to attach and remove. Most bipods are heavy and add weight to the front of the rifle, which is not desirable for proper balance of a rifle when holding the rifle. Also, most bipods that attached to a rifle are expensive.

It is an object of the present invention to provide a bipod that is easy to attach to a rifle.

It is an object of the present invention to provide a bipod that is lightweight.

SUMMARY OF THE INVENTION

A bipod support to support a firearm. There is a leg support. There are two legs, where each of the legs includes a support end. The support end includes a pin hole. The leg support includes two leg slots to receive one of the two legs. The leg support includes two pin holes. The support ends attached to the leg support by placing each of the support ends in one of the leg slots and inserting a pin into the pin holes of the leg support and the support end of the legs. There is a spring between each of the leg slots and each of the support ends of the legs. There is a ball to be mounted to a rifle stock. The ball is spherical in shape with two flat entrance sides on the ball. There is a ball mount receiver to receive the ball.

DETAILED DESCRIPTION

Figure 1:
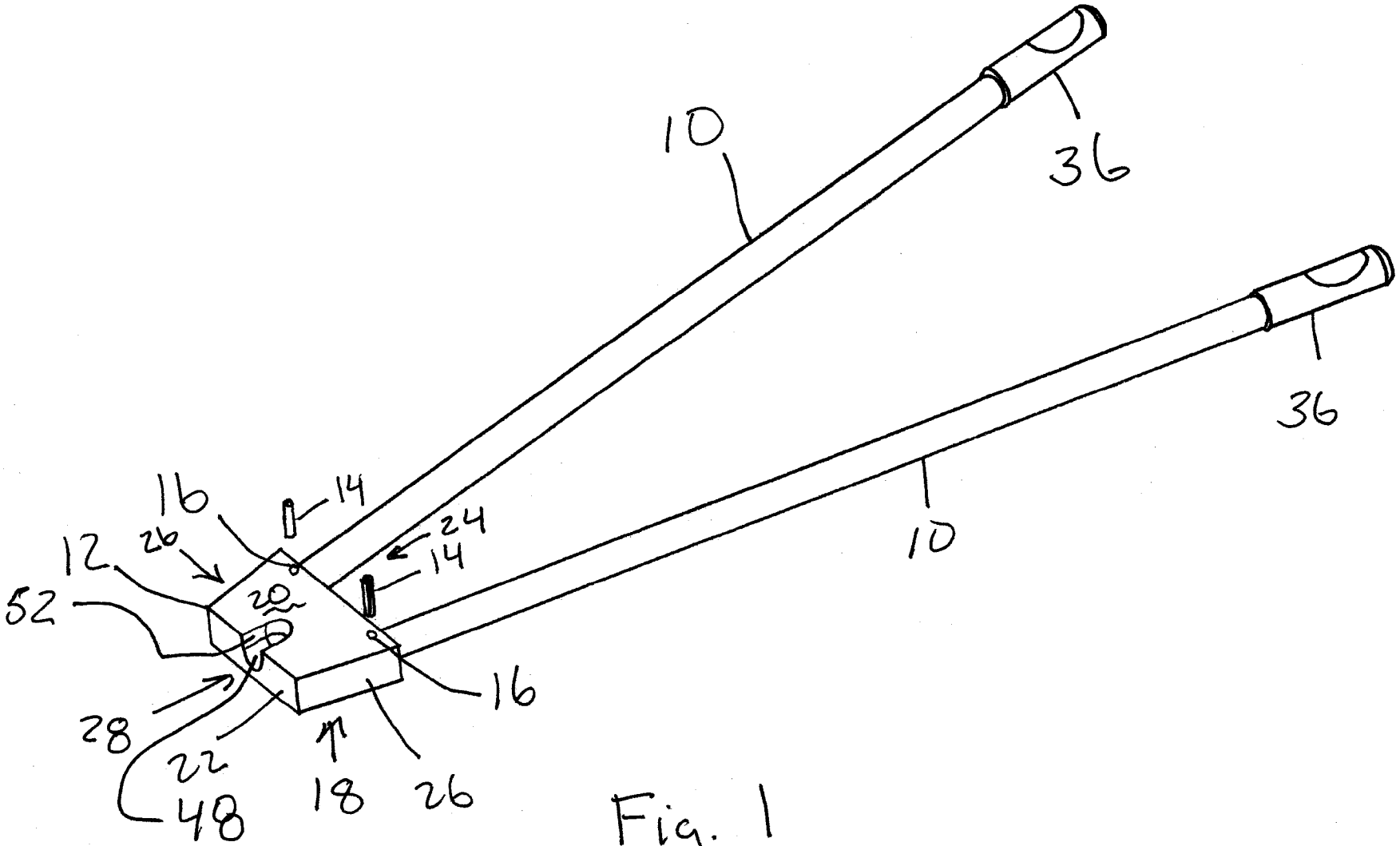
FIG. 1 is a perspective view of a bipod support according to the present invention.
Figure 2:
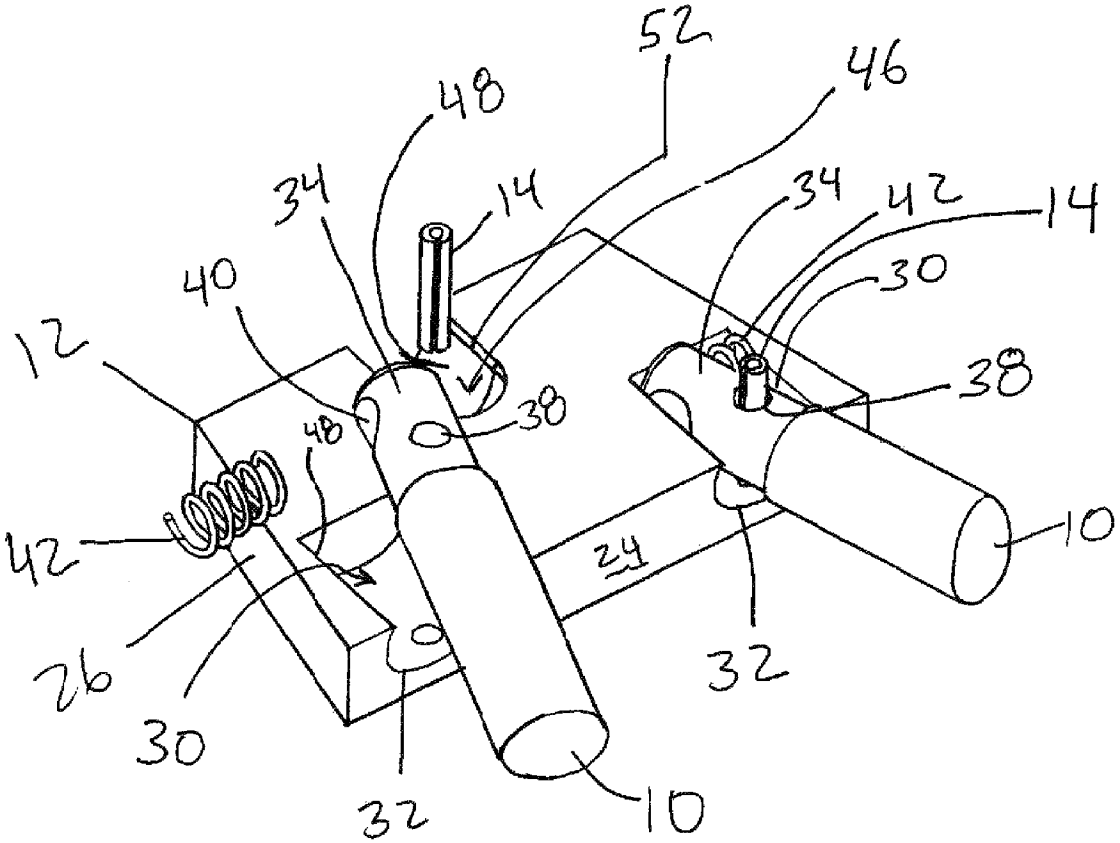
FIG. 2 is a perspective cutaway view of a bipod support according to the present invention.
Figure 3:
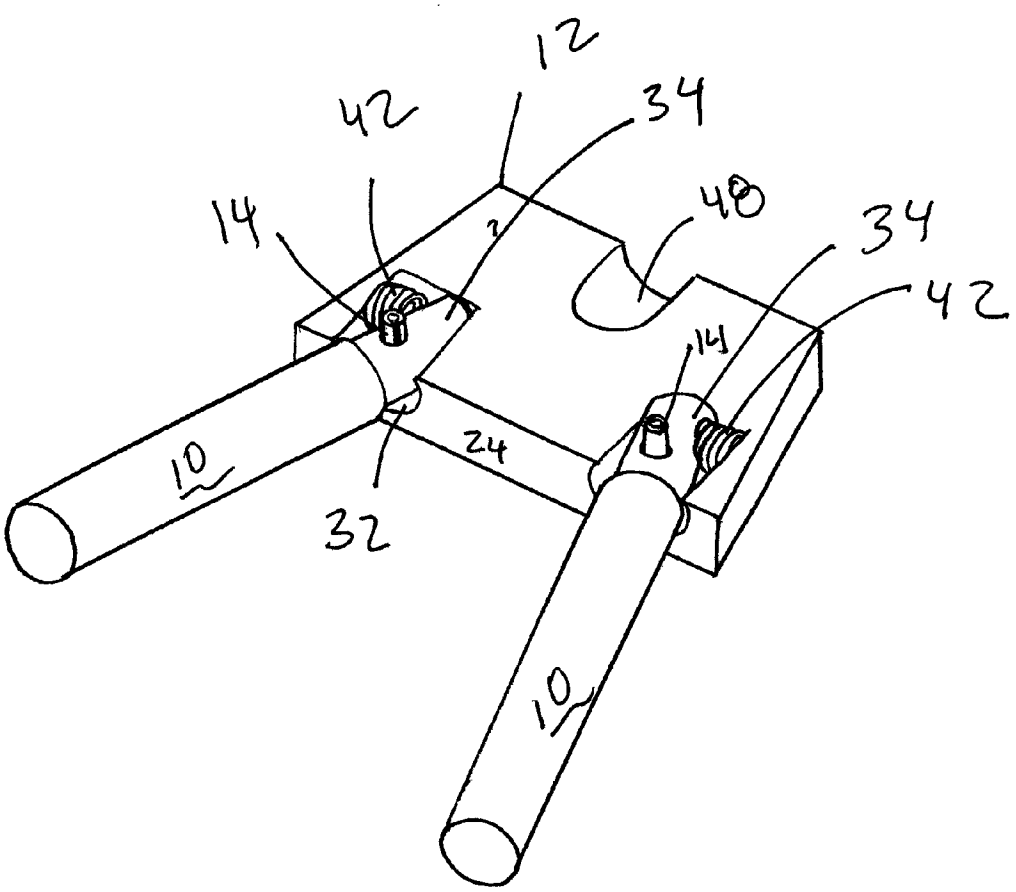
FIG. 3 is a perspective cutaway view of a bipod support according to the present invention.
Figure 12:
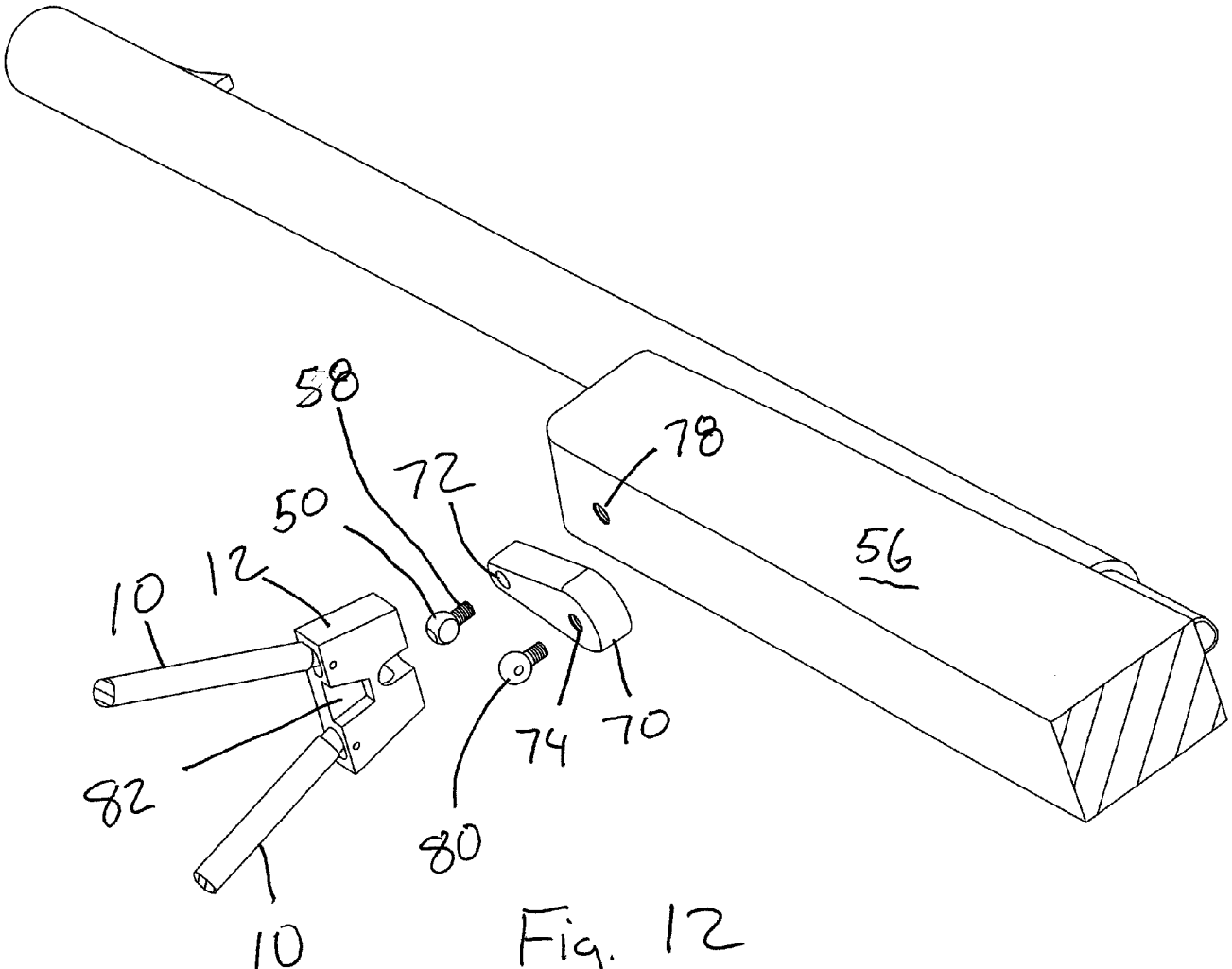
FIG. 12 is a perspective view of bipod mount according to the present invention.
Figure 13:
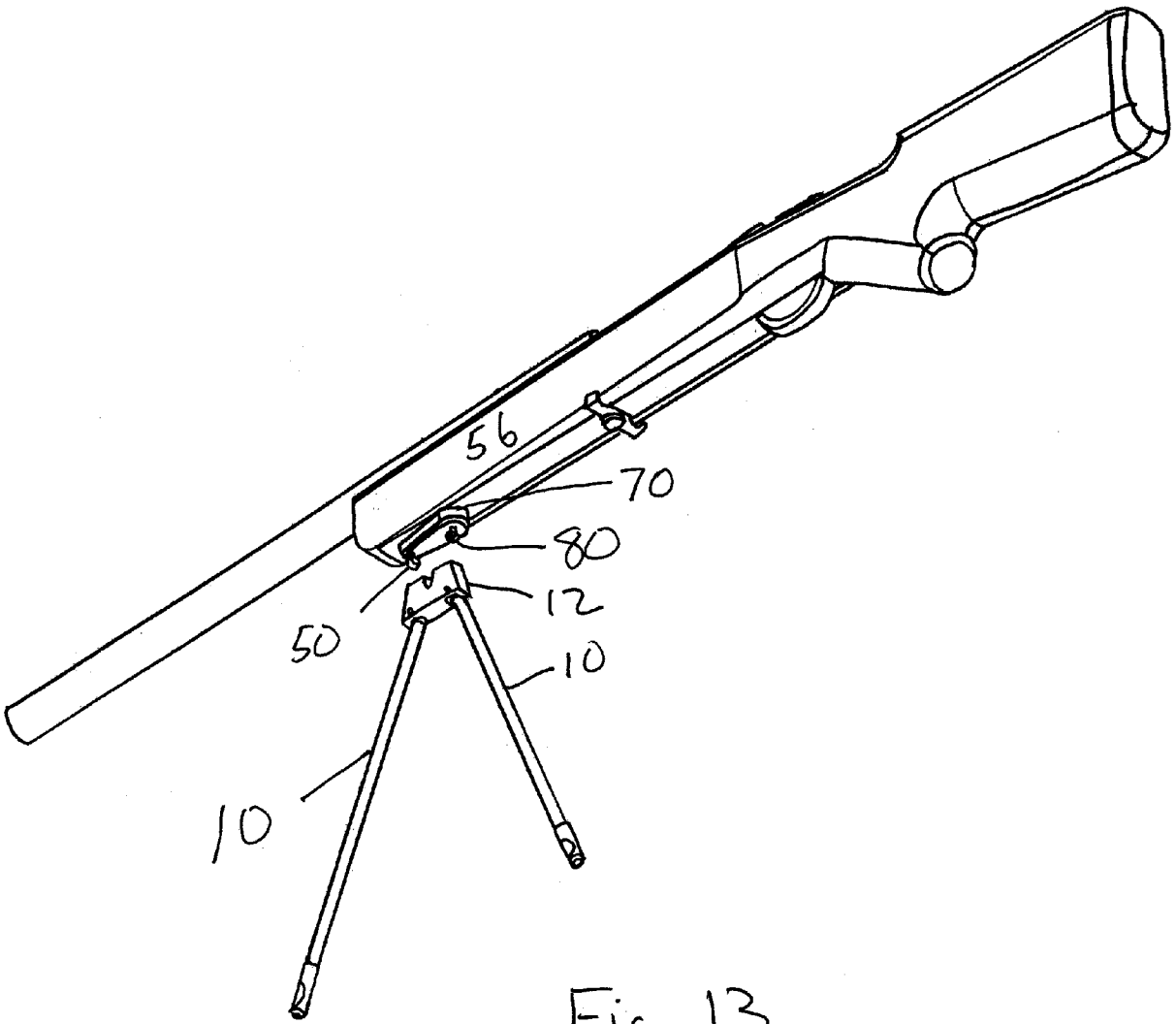
FIG. 13 is a perspective view of attachment of a bipod support to the bipod mount of FIG. 12 according to the present invention.
Figure 14:
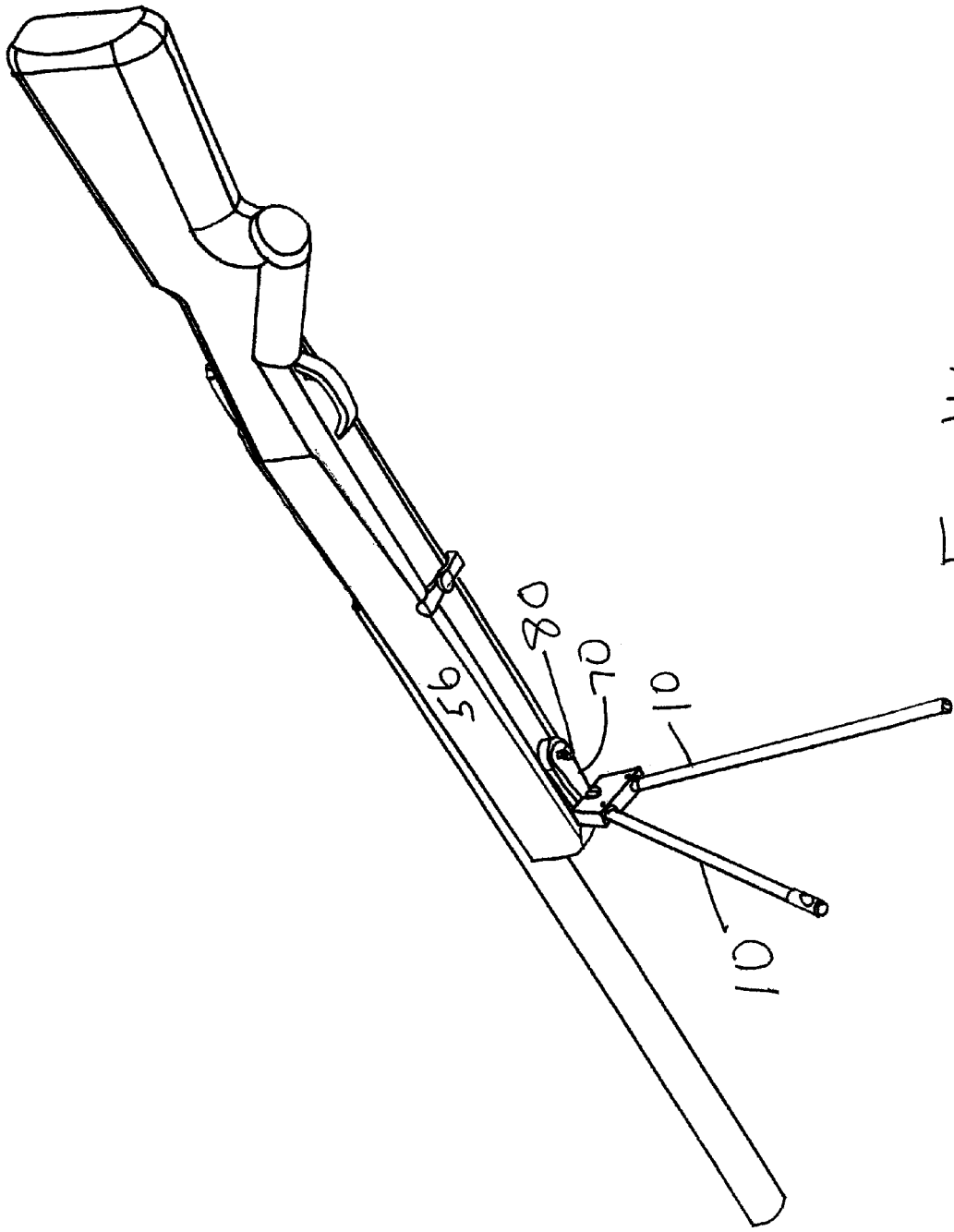
FIG. 14 is a perspective view of attachment of a bipod support to the bipod mount of FIG. 12 according to the present invention.
Figure 15:
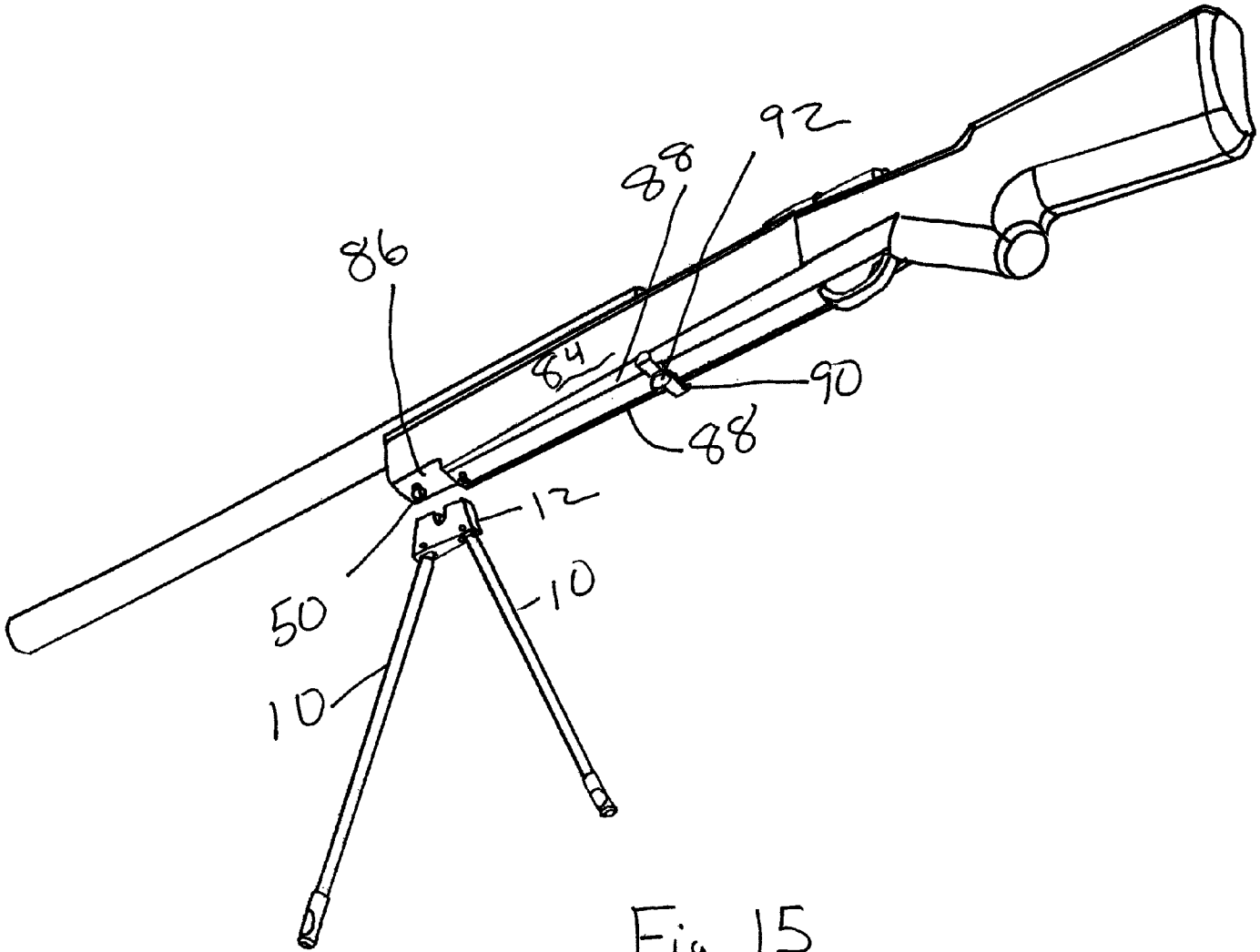
FIG. 15 is a perspective view of rifle stock for used with the bipod support of FIG. 1 according to the present invention.
Figure 16:
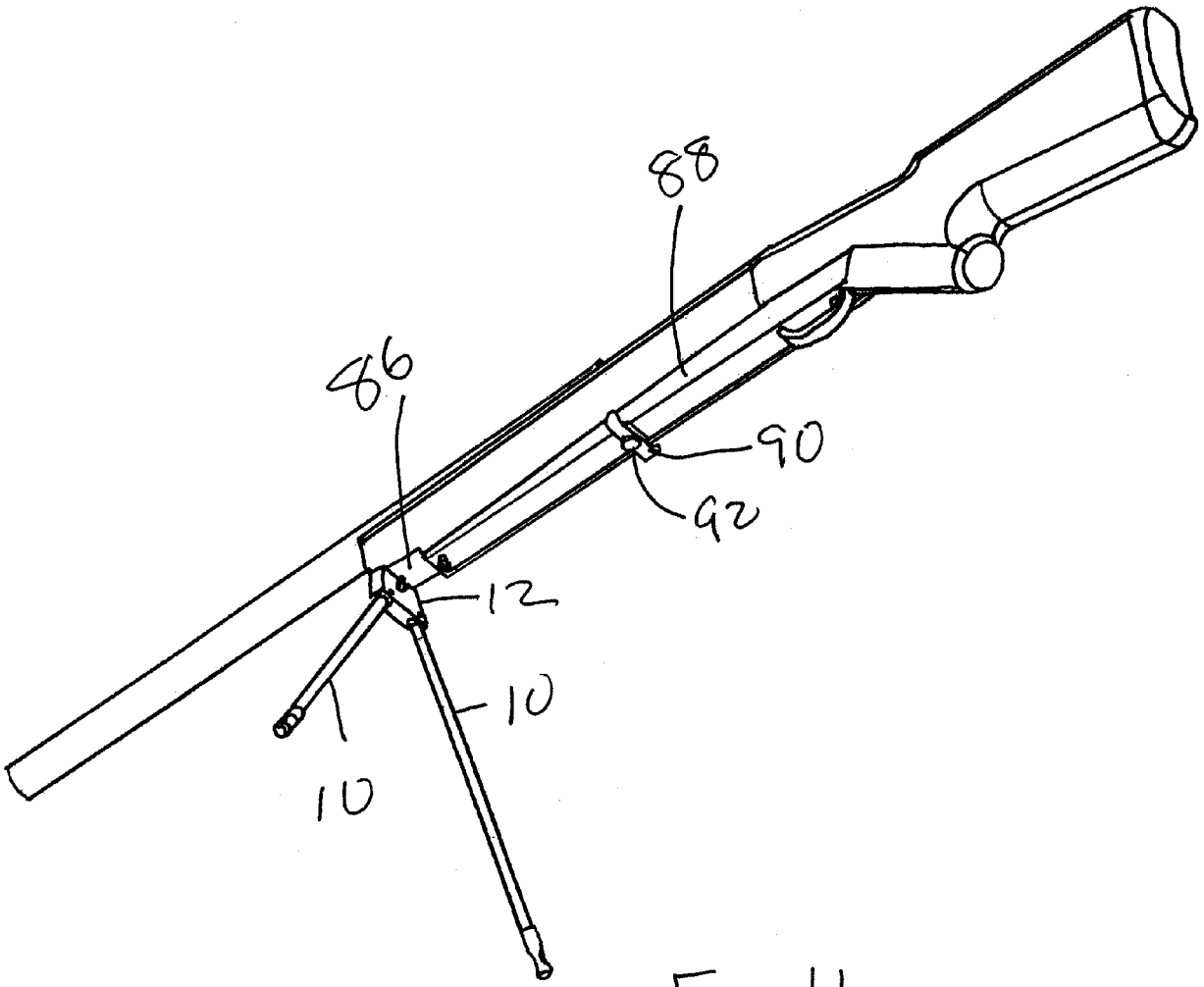
FIG. 16 is a perspective view of rifle stock for used with the bipod support of FIG. 1 according to the present invention.
Figure 17:
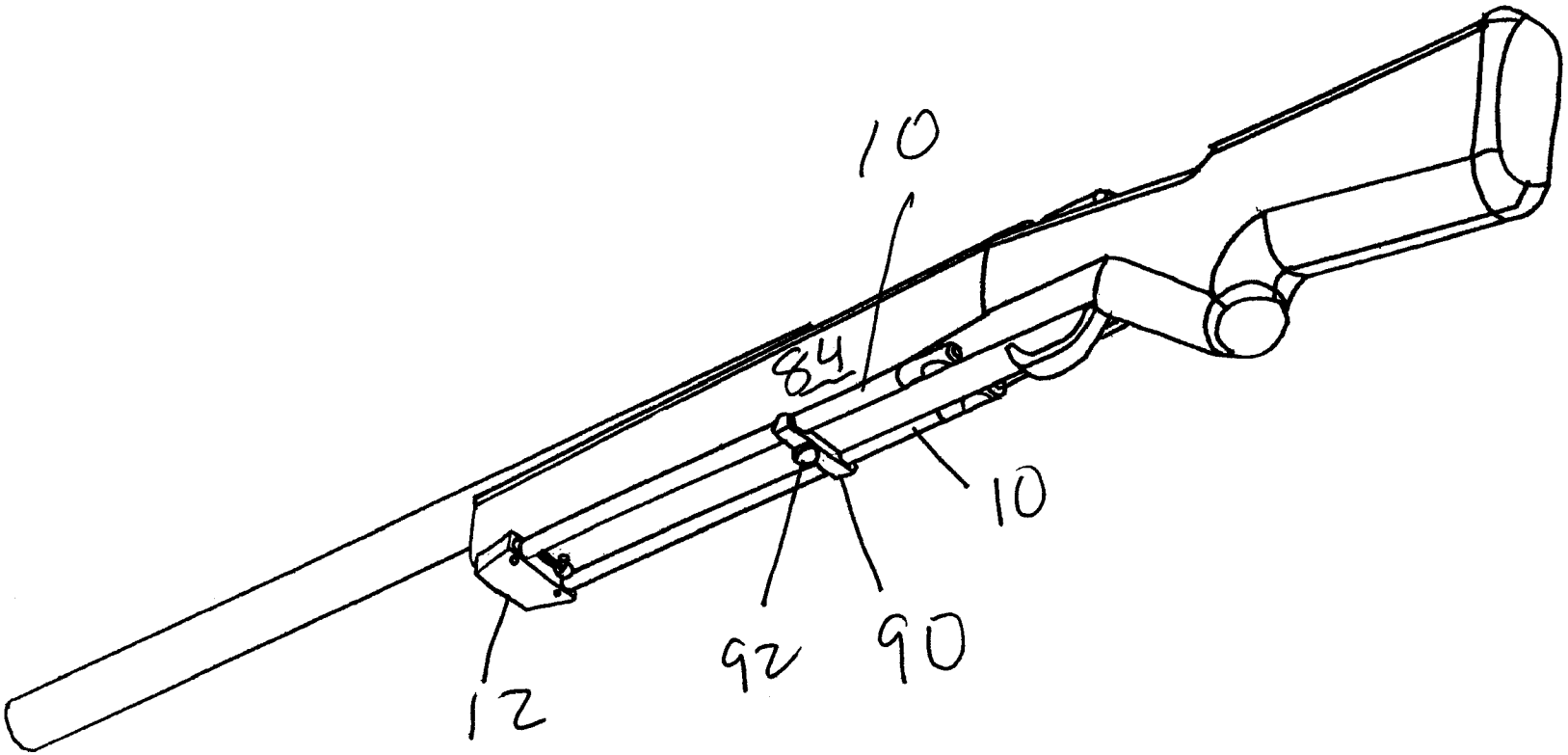
FIG. 17 is a perspective view of rifle stock for used with the bipod support of FIG. 1 according to the present invention.

The present invention is a bipod support, as shown in FIGS. 1-17. The present invention also is a bipod mount and rifle stock for use with the bipod mount. FIGS. 1-3 show the bipod. FIGS. 4-11 show how the bipod is mounted to a rifle using a sling mount hole of the stock of the rifle. FIGS. 12-14 show a bipod mount that can be used with the bipod support and which allows the use of a sling with the bipod support. FIGS. 15-17 show a rifle stock for use with the bipod support. The bipod support described below is lightweight and could be consider Ultra lightweight, as compared to current bipod supports.

The bipod support includes two legs 10 and a leg support 12, as shown in FIG. 1. FIG. 1 shows two roll pins 14 to secure the legs 10 to the leg support 12 using roll pin holes 16. The leg support includes a front face 18, rear face 20, top 22, bottom 24 and two sides 26. FIG. 1 also shows a ball mount receiver 28, as part of the leg support 12. FIGS. 2-3 show a cutaway drawing of the leg support 12. The leg support 12 includes two leg slots 30, such that each leg slot 30 receives one of the legs 10 from leg slot openings 32 in the bottom 24 of the leg support 12 that acts as an entrance for the legs 10. One of the roll pin holes 16 of the leg support 12 can be seen in FIG. 2. Each of the roll pin holes 16 of the leg support 12 are a through hole which passes through both the front face 18 and rear face 20 of the leg support 12 and is positioned to pass through each of the leg slots 30. The legs 10 include support ends 34 and surface ends 36. The surface ends 36 of the legs 10 are for resting the bipod support on a surface. Each support end 34 of each leg 10 inserts into one of the leg slots 30 as shown in FIG. 2. Each support end 34 of each leg 10 includes a roll pin hole 38 and a spring recess 40. The leg slots 30 are wide enough to allow each support end 34 of each leg 10 to rotate about the roll pin 14 while in the leg slot 30. This allows each leg 10 to extend outward at an angle from the leg support 12, as shown in FIG. 1, or be rotated inward, such that the legs 10 extend straight out from the leg support 12 for storage. FIG. 2 shows a spring 42 between a wall 44 of the leg slot 30 and the spring recess 40 of the support end 34. FIG. 3 shows both springs 42 installed. The springs 42 bias each support end 34 inward, such that the support end 34 rotates about the roll pin 14 and extends the legs 10 outward at an angle from the leg support 12. The ball mount receiver 28 shown in FIGS. 2-3 includes an entrance slot 46 and a ball retention area 48. The entrance slot 46 is machined to be smaller that the diameter of a spherical shaped ball 50 to be used. The entrance slot includes two parallel sides 52 which act as an entrance to the ball retention area 48. The ball 46 is shown in FIGS. 4-18 and has two sphere portions of the diameter removed to form two flat entrance sides 54 on the ball 50. The two entrance sides 54 are parallel to each other. The ball retention area 48 is large enough to received the diameter of the ball 50 and allows the leg support 12 to rotate about the ball 50.

Figure 4:
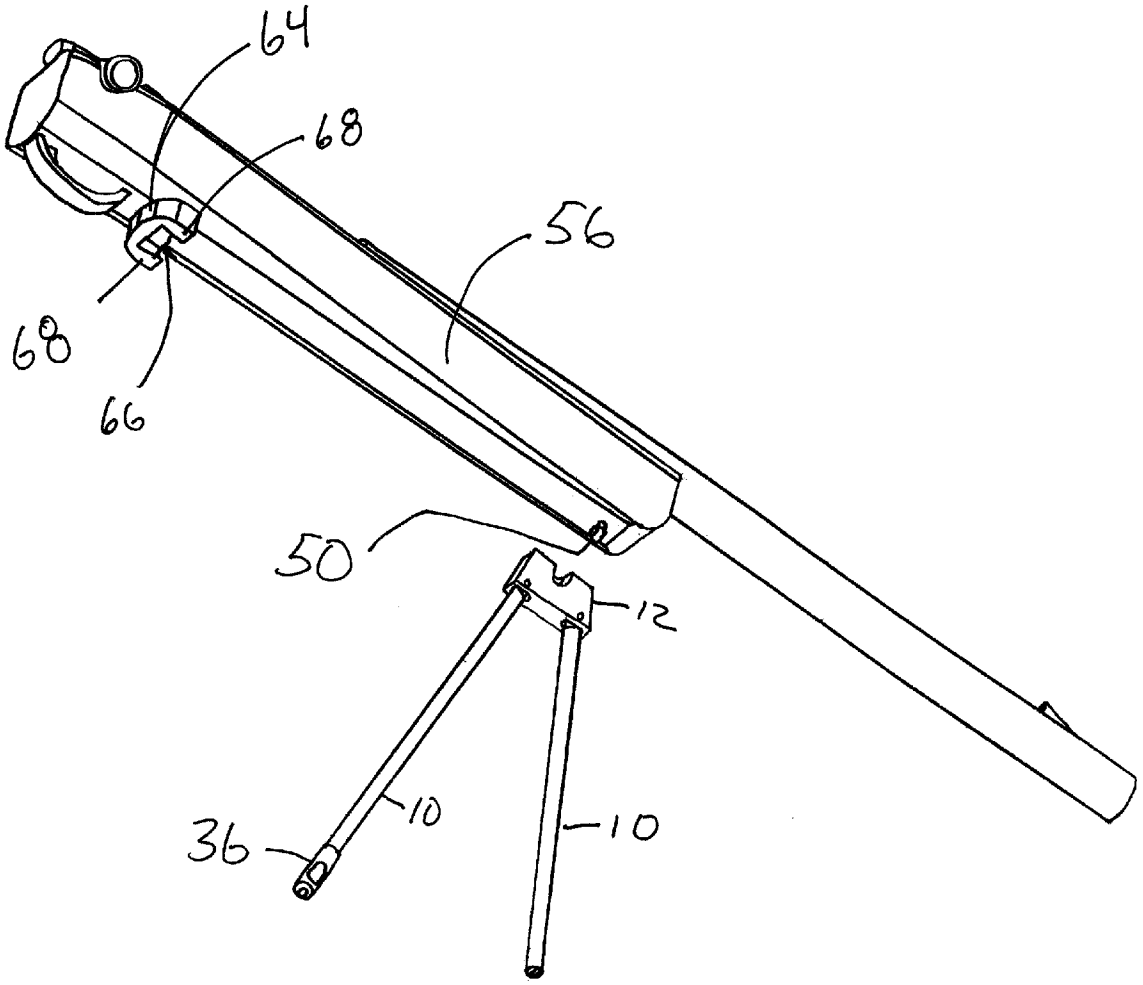
FIG. 4 is a perspective view of attachment of a bipod support to a rifle according to the present invention.
Figure 5:
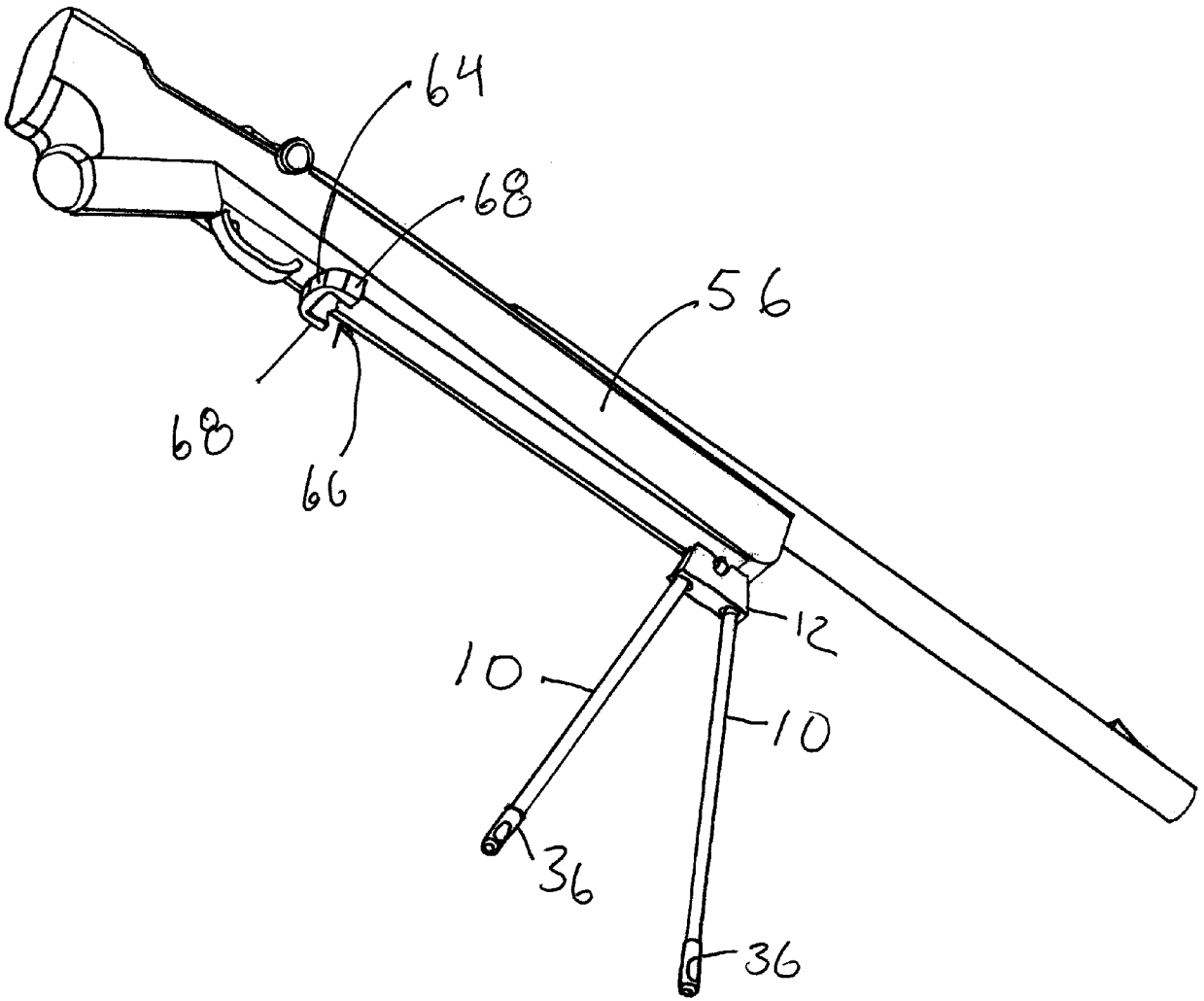
FIG. 5 is a perspective view of attachment of a bipod support to a rifle according to the present invention.
Figure 6:
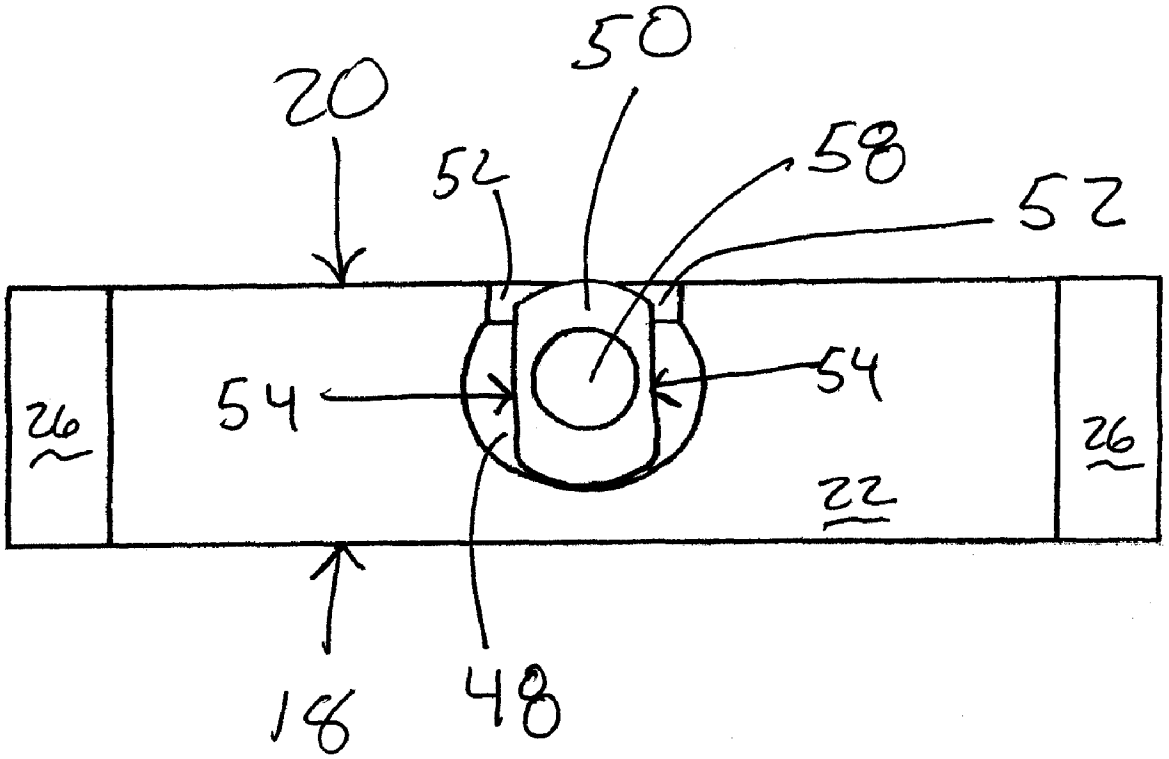
FIG. 6 is a top view of a bipod support according to the present invention.
Figure 7:
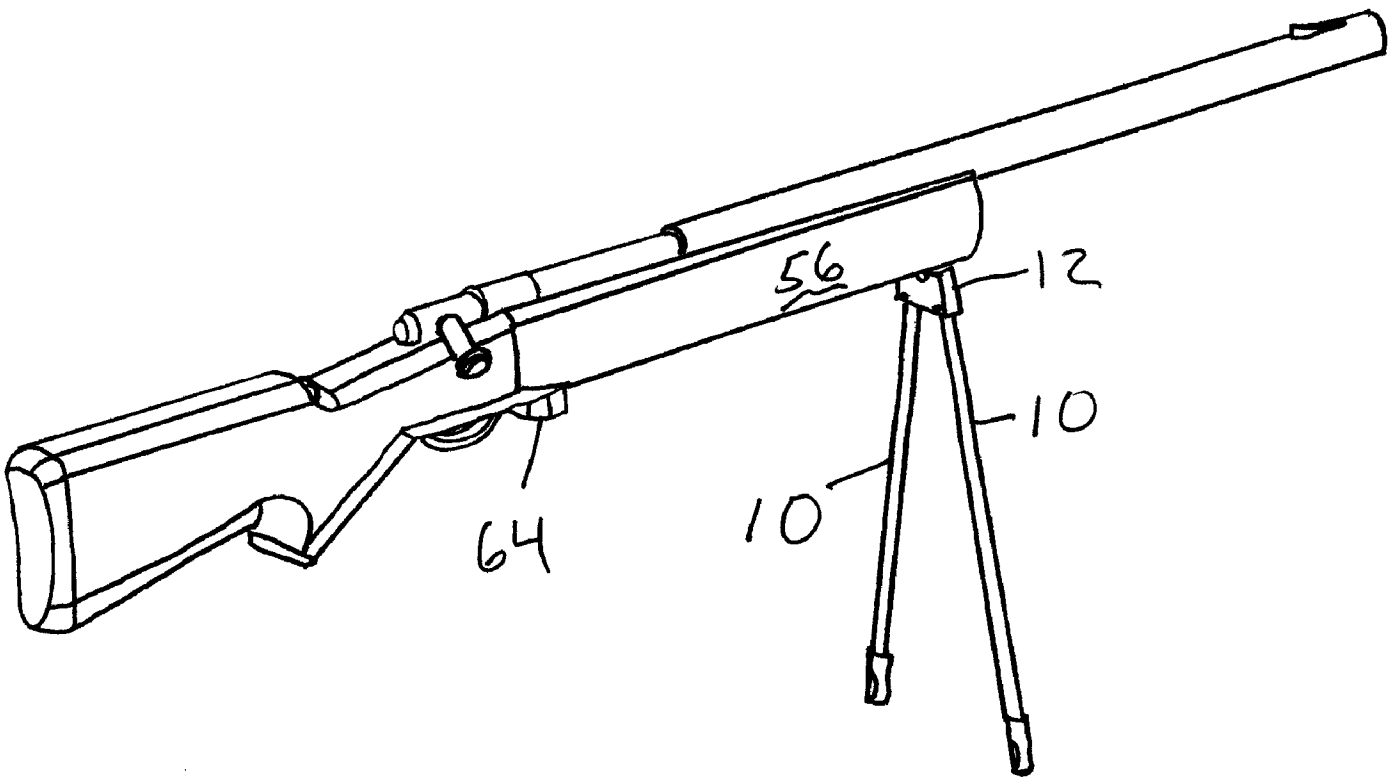
FIG. 7 is a perspective view of attachment of a bipod support to a rifle according to the present invention.
Figure 8:
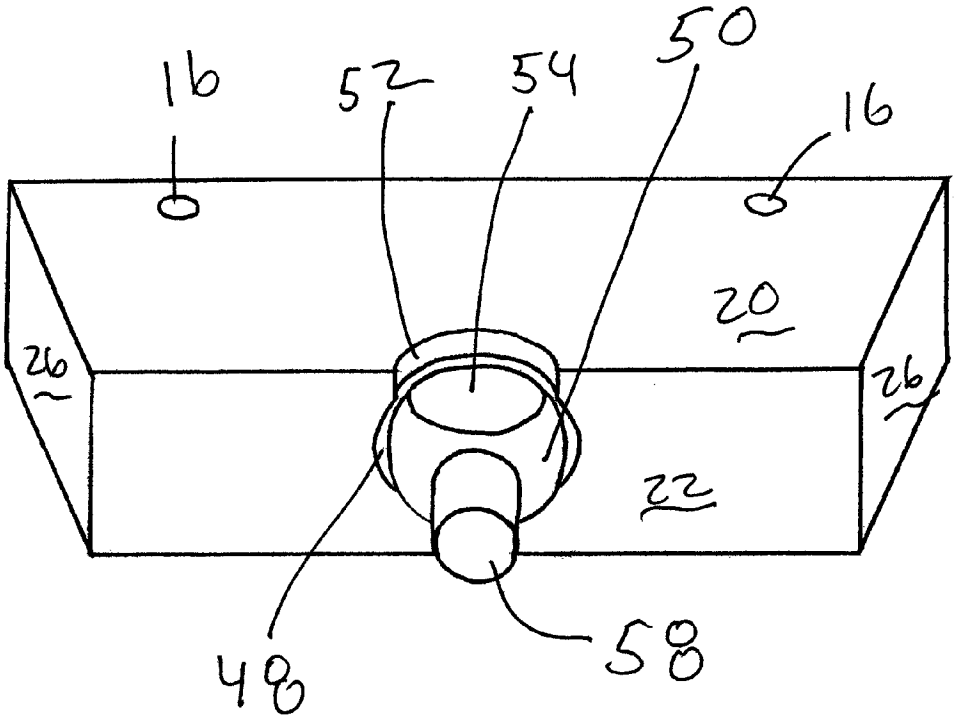
FIG. 8 is a perspective view of a bipod support according to the present invention.
Figure 9:
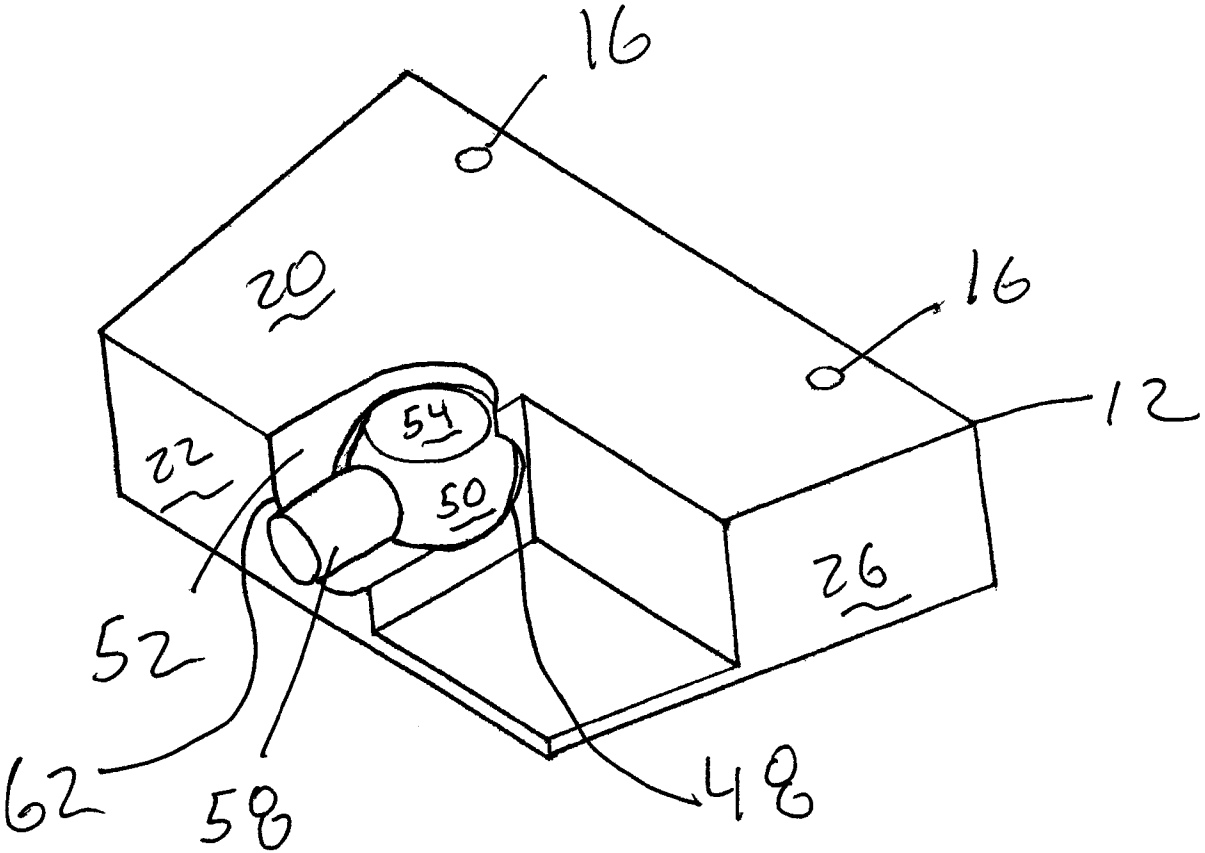
FIG. 9 is a perspective cutaway view of a bipod support according to the present invention.
Figure 10:
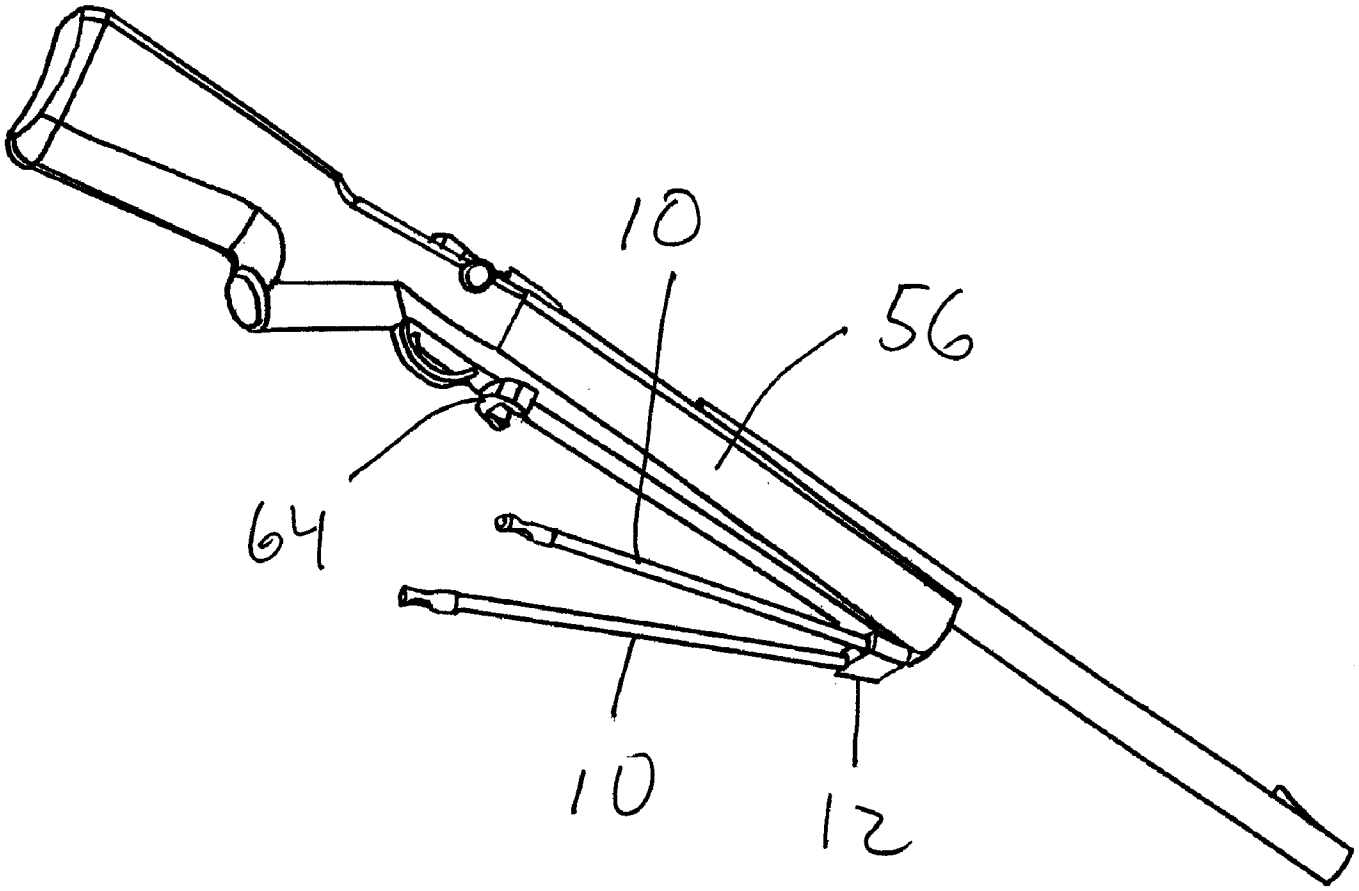
FIG. 10 is a perspective view of attachment of a bipod support to a rifle according to the present invention.
Figure 11:
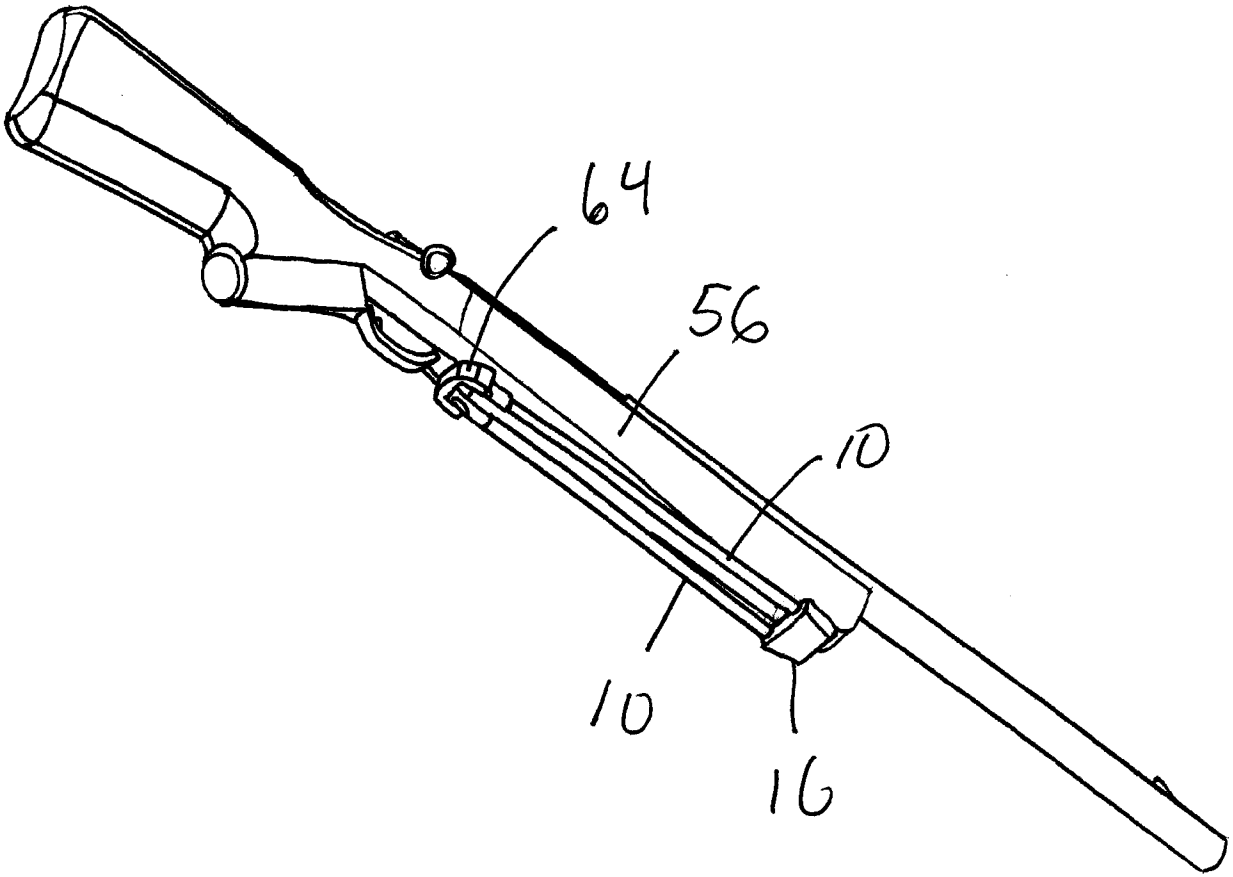
FIG. 11 is a perspective view of attachment of a bipod support to a rifle according to the present invention.

FIGS. 4-11 show the mounting of the bipod support 54 on a forearm 56 of a rifle stock that includes the ball 50. FIG. 4 shows the bipod support 12 before being placed on the rifle. Shown is the ball 50 mounted in the position normally held by a sling post for attaching a sling to the front of a rifle. The bipod support 12 is shown sideways to the rifle before mounting. FIG. 5 shows the bipod support 12 being slid onto the ball 50. FIG. 6 shows a close up view from the top of the ball 50 and leg support 12 with the rifle removed. The ball 50 includes a shaft 58 which extends upward from the ball 50. The shaft 58 is usually threaded to go in a screw hole on the forearm 56 of the rifle. The ball 50 is specially machined such that the entrance sides 54 are formed by removing some of the rounded areas of the ball 50. In FIG. 6, it can be seen from the top 22 of the bipod support 12, that the entrance slot 46 is smaller than the ball retention area 48. Therefore, only when the entrance sides 54 of the ball 50 are aligned and parallel with the entrance slot 46, will the leg support 12 slide onto the ball 50, as shown in FIG. 6. FIG. 4 shows that the entrance sides 54 of the ball 50 facing to the front and rear of the rifle and how the rear face 20 of the leg support 12 is aligned with the length of the rifle to be mounted to the ball 50. FIG. 7 shows the leg support 12 rotated ninety degrees as compared to its position in FIG. 5. FIG. 8 shows a close up top perspective view of the ball 50 and leg support 12 from FIG. 7 with the rifle removed. FIG. 8 shows that by rotating the leg support 12 about the ball 50, the ball 50 fits into the ball retention area 48. Once the leg support 12 is rotated, the leg support 12 can not be removed from the ball 50, unless the leg support 12 is rotated such that the entrance sides 54 of the ball 50 align with the sides 52 of the entrance slot 46. FIG. 9 shows a further cutaway of the leg support 12 with the ball 50 installed. FIG. 9 shows how the ball retention area 48 is rounded and larger than the entrance slot 46, such that the ball retention area 48 allows the leg support 12 to rotate about the ball 50. FIG. 7 also shows the position of the leg support 12, when used to support the rifle. When the leg support 12 is in the position shown in FIG. 7, the top 22 of the leg support 12 contacts the forearm 56 of the rifle stock and acts as a stop to keep the leg support 12 from rotating any further forward, while the wall 60 of the ball mount receiver 28 comes in contact with the shaft 58 of the ball 50. FIG. 10 shows that the leg support 12 rotating back towards the forearm 56 of the rifle stock. The leg support 12 can rotate back towards the forearm 56 of the rifle stock because of the entrance slot 46 and the opening 62 in the leg support 12 for the shaft 58 of the ball 50. The leg support 12 is rotated back for storage. The legs 10 can be squeezed together due to the leg slots 30 and support ends 34 rotating about the roll pins 14. FIG. 11 shows the surface ends 36 of the legs 10 positioned in a leg keeper 64 that is mounted on the forearm 56 of the rifle stock. The leg keeper 64 has a surface end slot 66 to receive the surface ends 36. The leg keeper 64 also has two leg walls 68 which keep the legs 10 from rotating outward due to the springs 42 in the leg support 12.

FIG. 12 shows a bipod mount 70 that is mounted to the forearm 56 of rifle stock as shown in FIGS. 13-14. The bipod mount 70 includes a ball hole 72 and a sling screw hole 74. The bipod mount 70 is mounted to the forearm 56 of the rifle stock by inserting the shaft 58 of the ball 50 into the ball hole 72 of the bipod mount 70 and screwing the shaft 58 into the sling screw hole 78 of the forearm 56. The sling post 80 is screwed into the sling screw hole 76 of the bipod mount 70. The leg support 12 is shown with a sling post cutout 82 and is for use when the leg support 12 does not fit between the ball 50 and the sling post 80. The sling post cutout 82 provides an open area to receive the sling post 80, when the bipod support is in the storage position. FIGS. 13 and 14 show the attachment of the leg support 12 of the bipod support to the bipod mount 70, which mounts in the same manner as described for FIGS. 5 and 7.

FIG. 15 shows a rifle stock forearm 84 for used with the bipod support. The forearm 84 includes a leg support cutout 86 in front of the forearm 84. The leg support cutout 86 receives the ball 50. FIGS. 15 and 16 show the leg support 12 of the bipod support mounting to the ball 50 in the same manner as described for FIGS. 5 and 7. The leg support cutout 86 is large enough, so that when the bipod support is folded in the storage position, the leg support 12 folds flat into the leg support cutout 86, as shown in FIG. 17. The forearm 84 includes leg groves 88 along the outside surfaces of the forearm 84. The leg grooves 88 receive the legs 10 when the bipod support is folded in the storage position, as shown in FIG. 17. The forearm 84 also includes a band strap 90 which is mounted to the forearm 84 using a spring loaded pin 92. The band strap 90 can be lifted to allow the legs 10 to be squeezed under the band strap 90. The band strap 90 retains the legs 10 in the grooves 88.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A bipod support, adapted to support a firearm, comprising:

a leg support having a top, bottom, a front face, a rear face and two sides;

two legs, each of said legs including a support end and a surface end, said support end including a pin hole;

two pins;

said leg support including two leg slots, each of said leg slots for receiving said support end of one of said two legs, each of said leg slots having an opening at said bottom of said leg support as an entrance to each of said leg slots by said support end of said legs, said leg support including two pin holes on said front face and two pin holes on said rear face, said pin holes of said front face aligned with said pin holes of said rear face such that there are two pairs of pin holes to receive said two pins, one of said pair of said pin holes aligned over one of said leg slots and the other of said pair of said pin holes aligned over the other of said leg slots, said support ends of said legs attached to said leg support by placing each of said support ends in one of said leg slots and inserting one of said pins into said pin holes of said leg support and said support end, each of said leg slots wide enough to allow rotation of said support end of legs about said pins;

a spring between each of said leg slots and each of said support ends of said legs to bias each leg in an outward position from said leg support;

a ball adapted to be mounted to a rifle stock, said ball having a diameter, said ball being spherical in shape with two sphere portions of said diameter removed to form two flat entrance sides on said ball, said entrance sides parallel to each other;

a ball mount receiver to receive said ball, said ball mount receiver including an entrance slot and a ball retention area, said entrance slot leading to said ball retention area, said entrance slot having two parallel slot sides that form said entrance slot, said entrance slot being smaller between said two slot sides than that of said diameter of said ball, such that said ball can only enter and exit said entrance slot when said entrance sides are parallel with said two slot sides, said ball retention area being large enough to receive said diameter of said ball from said entrance slot and allowing said leg support to rotate about said ball when said ball is in said ball retention area; and wherein said ball includes a shaft adapted to be attached to the rifle stock; wherein said top of said leg support includes a shaft opening above said ball mount receiver to allow passage of said shaft of said ball to pass outward from said top of said leg support; wherein said two parallel slot sides of said entrance slot are on said rear face of said leg support; wherein said two parallel slot sides of said entrance slot extend thru said top of said leg support such that there is an opening between said top of said leg support and said rear face of said leg support which continues to said shaft opening on said top of said leg support to allow said rear face of said leg support to be folded back against the rifle stock; and wherein said leg support includes a wall between said shaft opening and said front face of said leg support which comes in contact with said shaft when said leg support is used to support the rifle stock.

2. The bipod support of claim 1, wherein said support ends of said legs each include a spring recess to receive one of said springs.

3. The bipod support of claim 1, further including a leg keeper adapted to be mounted to the rifle stock, said leg keeper including a surface end slot to receive said surface ends of said legs, said leg keeper including two leg walls surrounding said surface end slot to keep said legs from rotating outward due to said springs in said leg support.

4. The bipod support of claim 3, wherein said support ends of said legs each include a spring recess to receive one of said springs.

5. The bipod support of claim 1, further including a bipod mount adapted to be mounted to the rifle stock at the front bottom of the rifle stock, said bipod mount including a base, said base including a ball hole to receive a shaft extending from said ball and a sling screw hole adapted to receive a sling post.

6. The bipod support of claim 5, wherein said leg support includes a sling post cutout to provide an open area to receive the sling post when said bipod support is in a storage position on the rifle stock.

7. The bipod support of claim 6, wherein said support ends of said legs each include a spring recess to receive one of said springs.

8. The bipod support of claim 5, wherein said support ends of said legs each include a spring recess to receive one of said springs.

9. The bipod support of claim 5, wherein said shaft of said ball is adapted to screw into the rifle stock and said shaft secures said bipod mount to the rifle stock.

10. The rifle stock of claim 1, wherein said ball and said ball mount receiver are positioned such that when said leg support is used to support the rifle stock, said top of said leg support near said front face of said leg support contacts a bottom of the rifle stock to act as a stop to keep said leg support from rotating any further forward.

11. A bipod mount adapted to be mounted to a rifle stock at the front bottom of the rifle stock to receive a ball and a sling post, comprising:

a base adapted to be mounted to the rifle stock;

a ball hole to receive a shaft extending from a ball; and a sling screw hole adapted to receive the sling post further including a bipod support, adapted to support a firearm, said bipod support comprising:

a leg support having a top, bottom, a front face, a rear face and two sides;

two legs, each of said legs including a support end and a surface end, said support end including a pin hole;

two pins;

said leg support including two leg slots, each of said leg slots for receiving said support end of one of said two legs, each of said leg slots having an opening at said bottom of said leg support as an entrance to each of said leg slots by said support end of said legs, said leg support including two pin holes on said front face and two pin holes on said rear face, said pin holes of said front face aligned with said pin holes of said rear face such that there are two pairs of pin holes to receive said two pins, one of said pair of said pin holes aligned over one of said leg slots and the other of said pair of said pin holes aligned over the other of said leg slots, said leg support ends attached to said leg support by placing each of said support ends in one of said leg slots and inserting one of said pins into said pin holes of said leg support and said support end, each of said leg slots wide enough to allow rotation of said support end of legs about said pins;

a spring between each of said leg slots and each of said support ends of said legs to bias each leg in an outward position from said leg support;

a ball adapted to be mounted to a rifle stock, said ball having a diameter, said ball being spherical in shape with two sphere portions of said diameter removed to form two flat entrance sides on said ball, said entrance sides parallel to each other; and a ball mount receiver to receive said ball, said ball mount receiver including an entrance slot and a ball retention area, said entrance slot leading to said ball retention area, said entrance slot having two parallel slot sides that form said entrance slot, said entrance slot being be smaller between said two slot sides than that of said diameter of said ball, such that said ball can only enter and exit said entrance slot when said entrance sides are parallel with said two slot sides, said ball retention area being large enough to received said diameter of said ball from said entrance slot and allowing said leg support to rotate about said ball when said ball is in said ball retention area; and wherein said ball includes a shaft adapted to be attached to the rifle stock; wherein said top of said leg support includes a shaft opening above said ball mount receiver to allow passage of said shaft of said ball to pass outward from said top of said leg support; wherein said two parallel slot sides of said entrance slot are on said rear face of said leg support; wherein said two parallel slot sides of said entrance slot extend thru said top of said leg support such that there is an opening between said top of said leg support and said rear face of said leg support which continues to said shaft opening on said top of said leg support to allow said rear face of said leg support to be folded back against the rifle stock; and wherein said leg support includes a wall between said shaft opening and said front face of said leg support which comes in contact with said shaft when said leg support is used to support the rifle stock.

12. The bipod support of claim 11, wherein said support ends of said legs each include a spring recess to receive one of said springs.

13. The rifle stock of claim 11, wherein said ball and said ball mount receiver are positioned such that when said leg support is used to support the rifle stock, said top of said leg support near said front face of said leg support contacts a bottom of the rifle stock to act as a stop to keep said leg support from rotating any further forward.

* * * * *